United States Patent [19]

Pace

[11] Patent Number: 4,825,550

[45] Date of Patent: May 2, 1989

[54] KNIFE AND SAW HOLDER

[76] Inventor: John F. Pace, 245 Myrtle Rd., Harrisburg, Pa. 17112

[21] Appl. No.: 86,776

[22] Filed: Aug. 19, 1987

[51] Int. Cl.[4] ..... B26B 27/00; A47F 5/00

[52] U.S. Cl. ..... 30/296 A; 248/316.3; 211/13

[58] Field of Search ..... 30/296 A, 136.5; 7/148; 211/13, 65, 70.7; 248/316.3

[56] References Cited

U.S. PATENT DOCUMENTS

| | | | |
|---|---|---|---|
| 481,455 | 8/1892 | Worden | 248/316.3 |
| 1,431,010 | 10/1922 | Koons et al. | 248/316.3 |
| 1,444,874 | 2/1923 | Hahn | 211/65 |
| 1,485,092 | 2/1924 | Rauchut | 211/65 X |
| 1,803,071 | 4/1931 | Ponlin | 211/65 |
| 2,357,646 | 9/1944 | Gilbert | 30/296 A |
| 2,590,297 | 3/1952 | Curtis II | 248/316.3 |
| 2,753,631 | 7/1956 | Culver | 30/296 A |
| 2,754,008 | 7/1956 | Culver | 30/296 A |
| 2,953,255 | 9/1960 | Higgins | 211/70.7 |
| 3,071,252 | 1/1963 | Hanschar | 211/70.7 |
| 3,580,394 | 5/1971 | Elliott | 248/316.3 |

*Primary Examiner*—Frank T. Yost
*Assistant Examiner*—Willmon Fridie, Jr.
*Attorney, Agent, or Firm*—Jerry T. Kearns

[57] ABSTRACT

A knife and saw holder has a base plate in which a disk is slidably received in a tapered groove. A cover plate has a narrow flared slot overlying the tapered groove. The disk is freely slidable along the groove in the base plate. By inserting the blade of a knife or a saw between the disk and the wall of the groove, the blade will be retained by the wedging action of the disk due to gravity.

1 Claim, 3 Drawing Sheets

KNIFE AND SAW HOLDER

BACKGROUND OF THE INVENTION

1. Field of the Invention

The present invention relates to knife and saw holders, and more particularly pertains to a new and improved knife and saw holder having a disk slidably retained in a tapered groove in a base plate. The knife and saw holder utilizes the force of gravity to retain knives and saws securely in position. When utilizing knives and saws, it is important to store these instruments in a neat and orderly way. This facilitates the location of these items, and further maintains the quality of their cutting edges. Also, it is important to store these instruments in a safe manner, so as to protect young children from these items.

2. Description of the Prior Art

Various types of knife and saw holders are known in the prior art. A typical example of such a knife and saw holder is found in U.S. Pat. No. 1,188,791, which issued to C. Knechtel on June 27, 1916. This patent discloses a rack which utilizes hinged slotted plates to mount a plurality of saws for display purposes. U.S. Pat. No. 1,661,121, which issued to G. Huson on Feb. 28, 1928, discloses a tool chest having a slotted holder designed to carry a plurality of saws with the blades extending in a horizontal position. The saws are inserted between two spaced slotted elements with their handles extending in alternating directions. The saws are vertically stacked one above the other. U.S. Pat. No. 1,888,289, which issued to F. Raffles on Nov. 22, 1932, discloses a holster like holder for a saw. A pair of felt pads positioned adjacent the opening of the holster are designed to provide a protective coating of grease or other substance to the sides of the saw blade during each insertion or removal of the blade from the holster. U.S. Pat. No. 2,495,866, which issued to A. Perry et al on Jan. 31, 1950, discloses a knife holder which has a plurality of vertically extending slanted slots for the reception and retention of knife blades. U.S. Pat. No. 2,754,008, which issued to P. Culver on July 10, 1956, discloses a knife rack having a plurality of horizontally spaced slots for the reception of the blades of knives. U.S. Pat. No. 3,677,400, which issued to J. Spier on July 18, 1972, discloses a storage unit for flatware which has a slotted central portion for supporting a plurality of knives in upright position. U.S. Pat. No. 3,980,608, which issued to E. Faltersack on Sept. 14, 1976, discloses a holder for knives which utilizes a housing having contained therein a plurality of resilient stacked "U" shaped members. In use, a knife is inserted between the sidewalls of two adjacent "U" shaped members, and is retained by the weight of the "U" shaped members. U.S. Pat. No. 4,064,991, which issued to H. Swanson on Dec. 27, 1977, discloses a paint brush rack for displaying paint brushes on a pegboard supporting surface. The rack has a plurality of support struts which extend at a forty five degree angle to the vertical pegboard surface. These struts are provided with horizontally extending flanges for forming a shelf for a paint brush. U.S. Pat. No. 4,134,499, which issued to S. Joswig on Jan. 16, 1979, discloses a holder for a plurality of tool handles of various diameters. A horizontally extending base has a plurality of angled grooves formed therein. A slide element secured by a projecting flanged element in a "T" groove provided in a sidewall of each slanted groove in the base plate slides on an incline under the action of gravity. When a handle is inserted upwardly between the slide elements and a sidewall of the groove and released, the weight of the slide elements wedges the tool shaft between the slide elements and the sidewall groove. U.S. Pat. No. 4,305,629, which issued to E. Friis on Dec. 15, 1981, discloses a drawer organizer for cutlery. The organizer provides a plurality of horizontally spaced slots for the reception of various cutlery items.

While the above mentioned devices are suited for their intended usage, none of these devices provides a holder for saws and knives which safely mounts these instruments in a vertically extending condition while at the same time allowing easy removal. Further, none of the above patents disclose a device which utilizes a disk freely slidable under the weight of gravity, to retain a knife or saw in position. Inasmuch as the art is relatively crowded with respect to these various types of knife and saw holders, it can be appreciated that there is a continuing need for and interest in improvements to such knife and saw holders, and in this respect, the present invention addresses this need and interest.

SUMMARY OF THE INVENTION

In view of the foregoing disadvantages inherent in the known types of knife and saw holders now present in the prior art, the present invention provides an improved knife and saw holder. As such, the general purpose of the present invention, which will be described subsequently in greater detail, is to provide a new and improved knife and saw holder which has all the advantages of the prior art knife and saw holders and none of the disadvantages.

To attain this, a representative embodiment of the concepts of the present invention is illustrated in the drawings and makes use of a base plate having a tapered slot in which a circular disk is freely slidable under the weight of gravity. A cover plate having a narrow flared channel is secured over the base plate and serves to retain the disk in the base plate channel. As many slots and disks as desired may be provided in the base and cover plates to allow a retention of a plurality of knives or saws.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved knife and saw holder which has all the advantages of the prior art knife and saw holders and none of the disadvantages.

It is another object of the present invention to provide a new and improved knife and saw holder which may be easily and efficiently manufactured and marketed.

It is a further object of the present invention to provide a new and improved knife and saw holder which is of a durable and reliable construction.

An even further object of the present invention is to provide a new and improved knife and saw holder which is susceptible of a low cost of manufacture with regard to both materials and labor, and which accordingly is then susceptible of low prices of sale to the consuming public, thereby making such knife and saw holders economically available to the buying public.

Still yet another object of the present invention is to provide a new and improved knife and saw holder which provides in the apparatuses and methods of the prior art some of the advantages thereof, while simultaneously overcoming some of the disadvantages normally associated therewith.

Still another object of the present invention is to provide a new and improved knife and saw holder which utilizes a freely slidable disk in cooperation with the force of gravity to firmly clamp the blades of knives or saws.

Yet another object of the present invention is to provide a new and improved knife and saw holder which clamps the blades of knives or saws in a vertically extending position, yet allows easy one handed removal of the knives or saws from the holder.

Even still another object of the present invention is to provide a new and improved knife and saw holder which utilizes a circular disk in cooperation with the sidewalls of a tapered groove to securely wedge the blades of knives and saws in a vertically extending, on edge position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
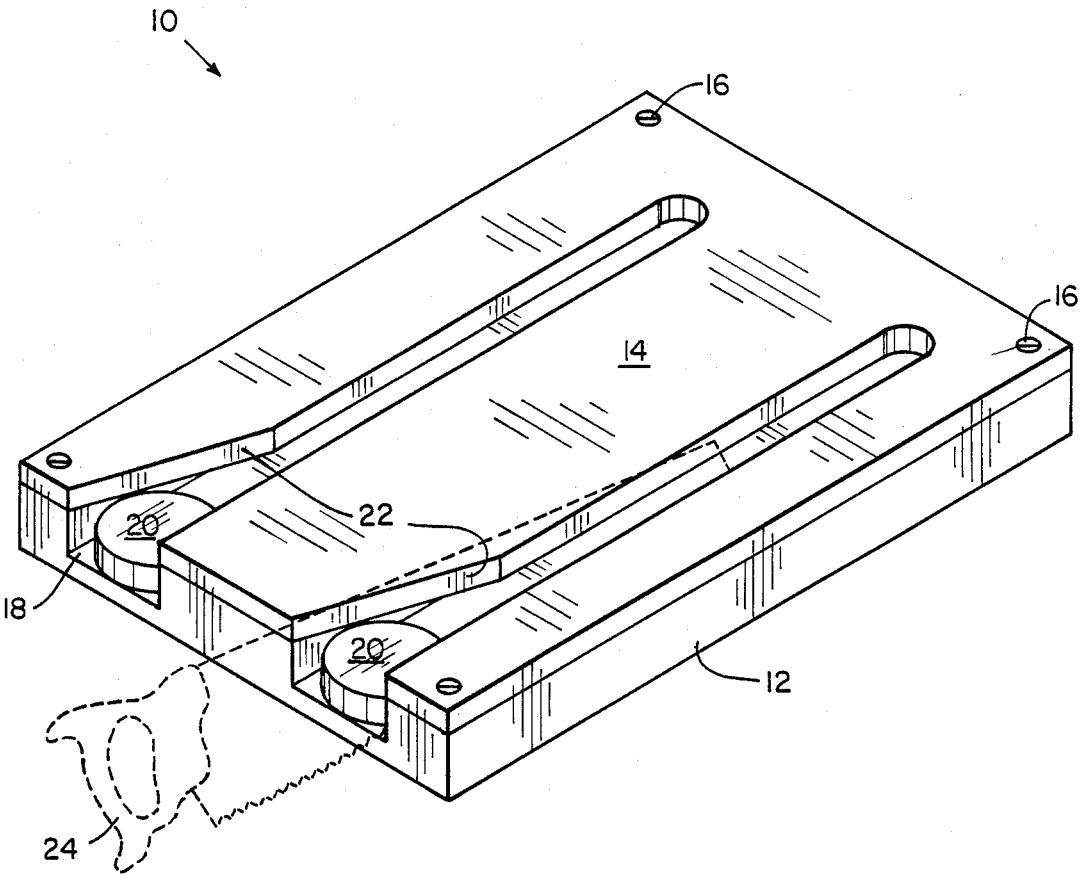
FIG. 1 is a perspective view of the knife and saw holder of the present invention.

With reference now to the drawings, and in particular to FIG. 1 thereof, a new and improved knife and saw holder embodying the principles and concepts of the present invention and generally designated by the reference numeral 10 will be described.

More specifically, it will be noted that the first embodiment 10 of the invention includes a base plate 12 on which a cover plate 14 is removably secured by means of a plurality of screws 16. A plurality of tapered grooves 18 are formed in the base plate 12. The narrow ends of the grooves 18 are visible in FIG. 1. A plurality of cooperating flared channel slots 22 are formed in the cover plate 14 and in an assembled condition, overlie the slots 18 in the base plate 12. A circular disk 20 is freely slidable in each of the grooves 18 in the base plate 12. The disks 20 each have a diameter which precludes them from falling out the open end of the slots 18. The disks 20 are retained in the grooves 18 by the overlying edges of the cover plate 14. A saw 24, shown in dotted outline is secured between the disk 20 and the sidewall of the groove 18.

The operation of the knife and saw holder of the present invention will now be briefly described. In use, the base plate 12 is mounted on a vertical wall. Thus, disks 20 slide down to the bottom narrow ends of the grooves 18. The blade of a knife or saw 24 is placed between the disk 20 and the sidewall of the groove 18 and is pushed vertically upwardly along the flared channel 22 in groove 18. During this operation, the disk 20 will be moved upwardly along the tapered groove 18. Upon release of the knife or saw 24, the blade will be clamped between the disk 20 and the sidewall of the groove 18 by the weight of the disk 20, and by the weight of the knife or saw 24, itself.

Figure 2:
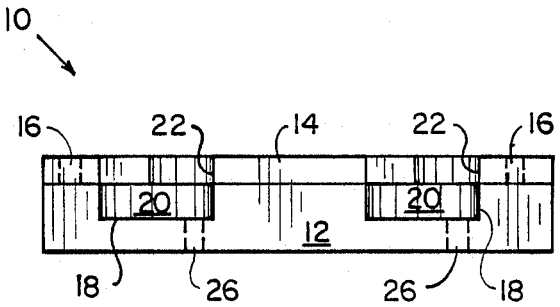
FIG. 2 is an end view of the knife and saw holder of the present invention.

With reference now to FIG. 2, an end view of the knife and saw holder 10 is provided. A pair of holes 26 extend through the bottom of the base plate 12 at an upper portion of the grooves 18. These holes 26 serve to mount the base plate 12 on a vertically extending wall. It is contemplated that a large headed fastener will be utilized, which will prevent disk 20 from being pushed out of the upper end of the groove 18. Alternatively, the grooves 18 may be provided with a closed end wall. The use of large headed fasteners in conjunction with holes 26 is preferred, as it allows long blades knives to extend further upwards into the holder. It should also be pointed out that holes 26 may extend through the cover plate 14, thus the shaft of a fastener would extend through the cover plate and base plate, thus preventing the disk 20 from being pushed out the upper end of the groove 18.

Figure 3:
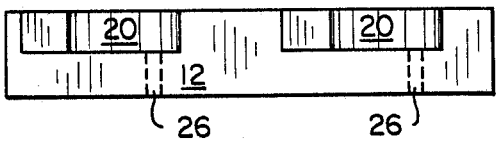
FIG. 3 is an end view of the base plate of the knife and saw holder of the present invention.

With reference now to FIG. 3, an end view of the base plate 12 with the cover plate 14 removed, is provided.

Figure 4:
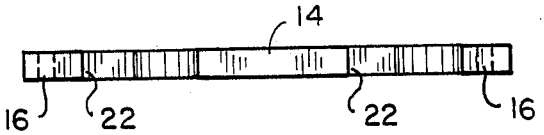
FIG. 4 is an end view of the cover plate of the knife and saw holder of the present invention.

With reference now to FIG. 4, an end view of the cover plate 14, removed from the base plate 12, is provided.

Figure 5:
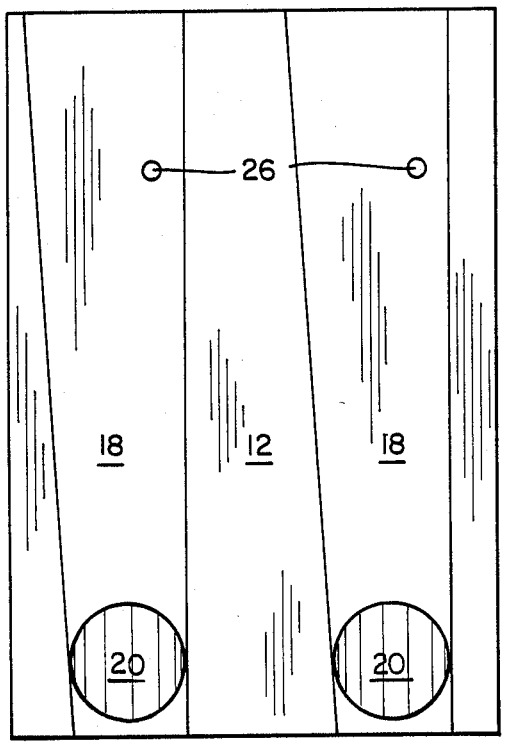
FIG. 5 is a top plan view of the base plate of the knife and saw holder of the present invention.

With reference now to FIG. 5, holes 26 may be seen extending through base plate 12 at an upper portion of each groove 18. These holes 26 are positioned such that a large headed fastener utilized to mount the base plate 12 to a vertically extending wall will also serve to retain disks 20 in the grooves 18. It is also pointed out that each of the tapered grooves 18 if formed of a first vertically extending straight sidewall and an opposed angled side wall.

Figure 6:
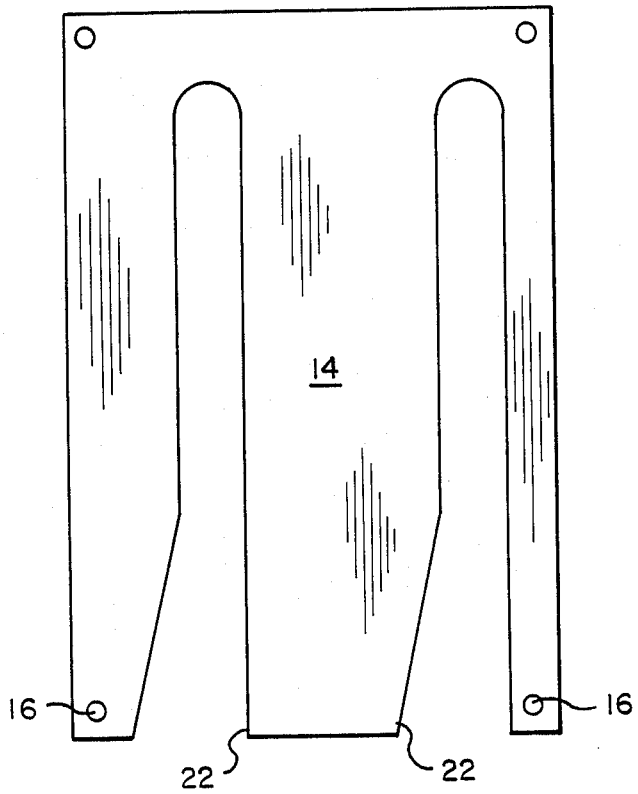
FIG. 6 is a top plan view of the cover plate of the knife and saw holder of the present invention.

With reference now to FIG. 6, a top plan view of cover plate 14, removed from base plate 12, is provided. The construction of the flared channel slots 22 is clearly illustrated. Each of the channel slots 22 is provided with a closed, radiused upper end which limits the extent of insertion of a knife or saw blade. These narrow channel slots 22 also serve to enhance the appearance of the knife and saw holder of the present invention, making it suitable for mounting on a kitchen wall.

The manner of assembly and usage of the knife and saw holder of the present invention should now be readily understood, but for purposes of clarity, will now be again described. First of all, the base plate is mounted on a vertically upstanding wall by a pair of large headed fasteners through holes 26 as shown in FIG. 5. Cover plate 14 is then secured by means of a plurality of screws 16. Disks 20 are thus freely slidable in tapered grooves 18. In this condition, the blade of a knife or saw 24, as shown in FIG. 1, is inserted between the wall of the disk 20 and the sidewall of the groove 18. The blade is then pushed upwardly along the channel 22 and the cover plate 14, thus carrying disk 20 upwardly along the tapered groove 18. When the knife or saw 24 is in the desired position, the handle is simply released, allowing the blade to be clamped between the disk 20 and the sidewall of the groove 18. The weight of the disk 20 and the weight of the knife or saw 24 enhance the clamping effect.

The knife or saw holder 10 of the present invention may be formed of any desired material such as wood or plastic. The disks 20 may also be weighted, or formed of a dense material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A knife and saw holder, comprising:

a base plate;

at least one groove, having a tapered width, formed in said base plate;

said groove having a first straight side wall and a second straight sidewall extending at an acute angle to said first straight sidewall;

a circular disk, having a diameter greater than the smallest width of said tapered groove, freely slidably received in said groove, a cover plate secured to said base plate;

at least one slot formed through said cover plate;

said slot having a closed, radiused upper end portion;

said slot having an open flared bottom end disposed adjacent the smallest width portion of said tapered groove;

said slot having longitudinal edges which partially overlie said tapered groove for retaining said disk in said groove; and means for mounting said base plate to a vertically upstanding wall surface, said mounting means also serving to limit upward movement of said disk in said tapered groove.

* * * * *